US006040746A

United States Patent [19]

Maloney et al.

[11] Patent Number: 6,040,746

[45] Date of Patent: Mar. 21, 2000

[54] ACTUATION MECHANISM FOR TRIP ACTUATED BREAKER AUXILIARY MULTIPLE MICROSWITCH

[75] Inventors: James G. Maloney, Industry; Ronald D. Smiddle, Canonsburg, both of Pa.

[73] Assignee: Eaton Corporation, Cleveland, Ohio

[21] Appl. No.: 09/223,203

[22] Filed: Dec. 30, 1998

[51] Int. Cl.[7] ..... H01H 75/02; H01H 3/20; H01H 9/02

[52] U.S. Cl. ..... 335/13; 200/330; 200/573; 200/332.1

[58] Field of Search ..... 200/5, 17 R, 18, 200/330, 332.1, 573; 335/6, 13, 14, 15, 16, 17, 18, 159–163, 172–176, 185, 186, 189–191

[56] References Cited

U.S. PATENT DOCUMENTS

| | | | |
|---|---|---|---|
| 3,073,926 | 1/1963 | Ellsworth et al. . | |
| 3,566,318 | 2/1971 | Gelzheiser et al. . | |
| 3,665,348 | 5/1972 | Haydon et al. | 335/68 |
| 3,760,307 | 9/1973 | Patel | 335/13 |
| 3,806,686 | 4/1974 | Gaskill | 335/17 X |
| 4,081,852 | 3/1978 | Coley et al. . | |
| 4,209,761 | 6/1980 | Klein et al. . | |
| 4,641,216 | 2/1987 | Morris et al. . | |
| 4,641,217 | 2/1987 | Morris et al. . | |
| 4,768,025 | 8/1988 | Vila-Masot . | |
| 4,794,356 | 12/1988 | Yu et al. . | |
| 4,831,221 | 5/1989 | Yu et al. . | |
| 4,912,439 | 3/1990 | Nagy et al. . | |
| 4,928,079 | 5/1990 | Maie et al. | 335/13 |
| 4,939,490 | 7/1990 | Bernier et al. . | |
| 5,043,688 | 8/1991 | Castonguay et al. . | |
| 5,534,833 | 7/1996 | Castonguay et al. | 335/68 |
| 5,552,755 | 9/1996 | Fello et al. . | |

*Primary Examiner*—J. R. Scott
*Attorney, Agent, or Firm*—Martin J. Moran

[57] ABSTRACT

Microswitches, mounted in a compartment and molded housing of a circuit breaker separate from the compartment in which the circuit breaker mechanism is mounted, are actuated to indicate the operating status of the circuit breaker by cascaded first and second actuating members. The first actuating member bears against a cam surface on an operating member of the circuit breaker where the cam surface actuates the microswitches through the first actuating member when the operating member is in the off position. The second actuating member engages a cradle of the circuit breaker and actuates the microswitches through the first actuating member when the cradle is unlatched.

9 Claims, 4 Drawing Sheets

ACTUATION MECHANISM FOR TRIP ACTUATED BREAKER AUXILIARY MULTIPLE MICROSWITCH

BACKGROUND OF THE INVENTION

1. Field of the Invention

This invention relates generally to circuit breakers having more than one microswitch for providing an indication of the operating status of the circuit breaker and, more particularly, to the mechanism for simultaneously actuating the microswitches.

2. Background Information

Large multi-pole circuit breakers typically have a crossbar which links the poles together and opens the contacts in all phases if any phase trips open. Often, a microswitch, such as an auxiliary switch, is provided in such breakers to generate an external indication that the contacts are open such as for electrical interlocks between multiple circuit breakers or for remote monitoring of circuit breaker operation. Since the crossbar provides an indication of the state of the circuit breaker contacts, either opened or closed, the crossbar has been used to actuate the auxiliary switch. In some circuit breakers an additional microswitch, such as a bell alarm switch, is included which is actuated when the circuit breaker is tripped, again for remote monitoring of breaker operation.

The small circuit breakers used for residential and light commercial or industrial use do not typically have a crossbar with which a microswitch may work in cooperation to indicate the operating status of the breaker, namely because they are single pole. Adding microswitches to such small circuit breakers has been found to be difficult because such breakers typically have limited space due to their configuration for mounting in a standardized load center or panel board. U.S. Pat. No. 5,552,755 discloses an example of a small residential or light industrial or commercial circuit breaker which is provided with a microswitch to generate an electrical indication that the circuit breaker contacts are opened. Cascaded actuating members, one actuated by handle structure and one by the cradle, are incorporated into the circuit breaker for actuating a plunger of the microswitch and indicating the operating status of the breaker. However, the cascaded actuating member, while effective for actuating a single microswitch, is unable to effectively actuate two microswitches, or possibly more than two microswitches, that may be ganged together for indicating the operating status of the breaker or providing other functions which are generally known in the art.

There remains a need, therefore, for a small residential or light industrial or commercial circuit breaker which is provided with more than one microswitch for indicating the operating status of the breaker.

There is also a need for a small residential or light industrial or commercial circuit breaker having more than one microswitch where the microswitches may be simultaneously actuated. This must be accomplished within a standardized size of such circuit breakers so that they may be continued to be used in the standard load centers and panel boards.

SUMMARY OF THE INVENTION

These and other needs are satisfied by the invention which is directed to a circuit breaker suitable for residential and light commercial or industrial use which incorporates more than one microswitch. More particularly, the invention is directed to a circuit breaker of the type which includes a movable contact arm carrying a movable contact at one end and engaged at the other end by a pivotally mounted operating member having an integral handle, a pivotally mounted latchable cradle, a spring connecting the cradle and the contact arm, and trip device latching the cradle in a latched position and unlatching the cradle in response to an overcurrent condition to trip the contact arm and open the contacts while moving the operating member to a tripped position.

In one embodiment, the actuating means includes a first actuating member bearing against a cam surface on the operating member, where the cam surface actuates the microswitches through the first actuating member when the operating member and the integral handle are in the off position. The actuating means further includes a second actuating member engaging the cradle and actuating the microswitches through the first actuating member when the cradle member is unlatched. The first and second actuating members are cascaded to actuate the microswitches whenever the contacts are open, both upon tripping of the circuit breaker and when the handle is moved to the off position.

In another embodiment, the actuating means includes a first actuating member and a second actuating member where the second actuating member engages the cradle and actuates the first and second microswitches through the first actuating member when the cradle is unlatched. The first and second actuating members are cascaded to actuate the microswitches whenever the cradle is unlatched indicating that a tripping operation has occurred.

BRIEF DESCRIPTION OF THE DRAWINGS

A full understanding of the invention can be gained from the following description of the invention when read in conjunction with the accompanying drawings in which.

DESCRIPTION OF THE PREFERRED EMBODIMENTS

The invention will be shown as applied to a single pole residential or light commercial or industrial circuit breaker. However, it will be evident to those skilled in the art that the invention is also applicable to multi-pole circuit breakers as well.

Figure 1:
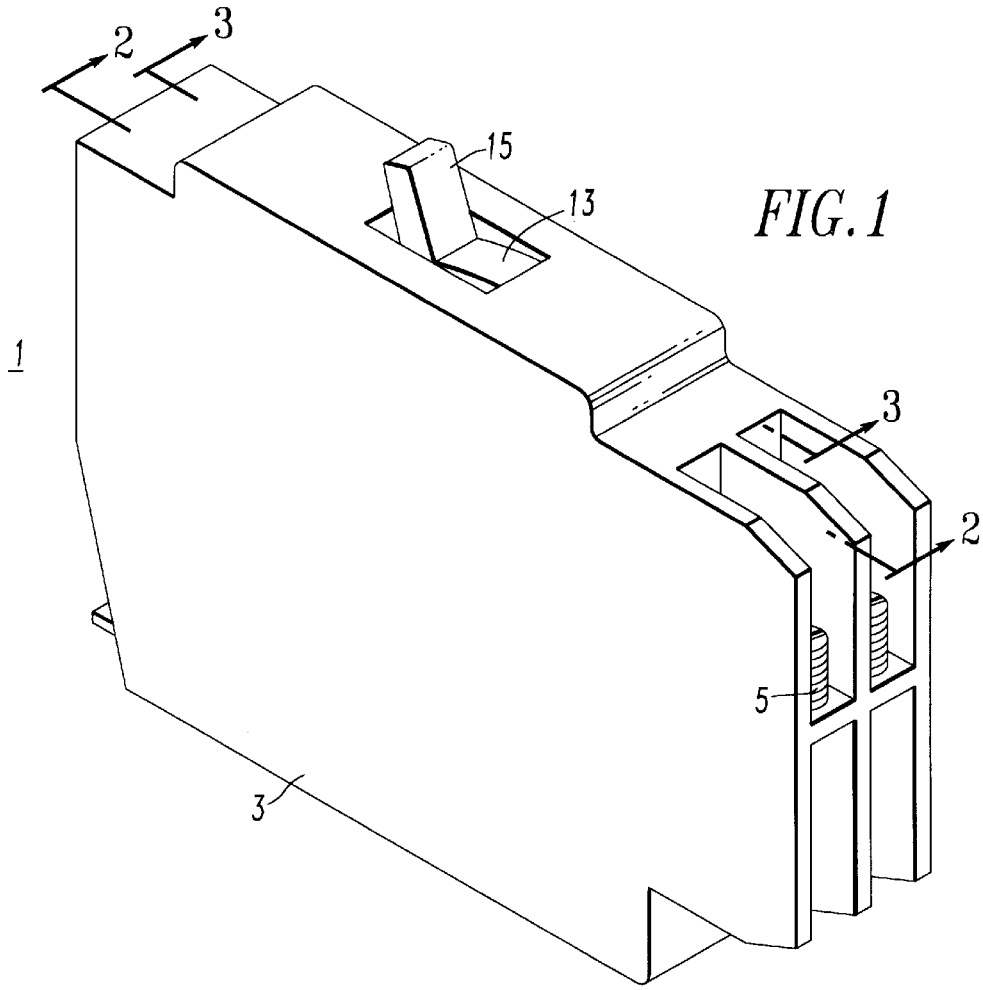
FIG. 1 is an isometric view of a circuit breaker to which the invention has been applied.

Referring to FIG. 1, the circuit breaker 1 comprises a housing 3 which is composed of electrically insulating material such as a thermo-setting resin. A load terminal 5 is provided for connecting the circuit breaker to a load. A line terminal 9 (see FIG. 2) is provided at the opposite end of the housing 3 for connection to a commercial power system. The circuit breaker 1 includes an operating member 13 having an integral molded handle 15 extending through the housing 3.

Figure 5:
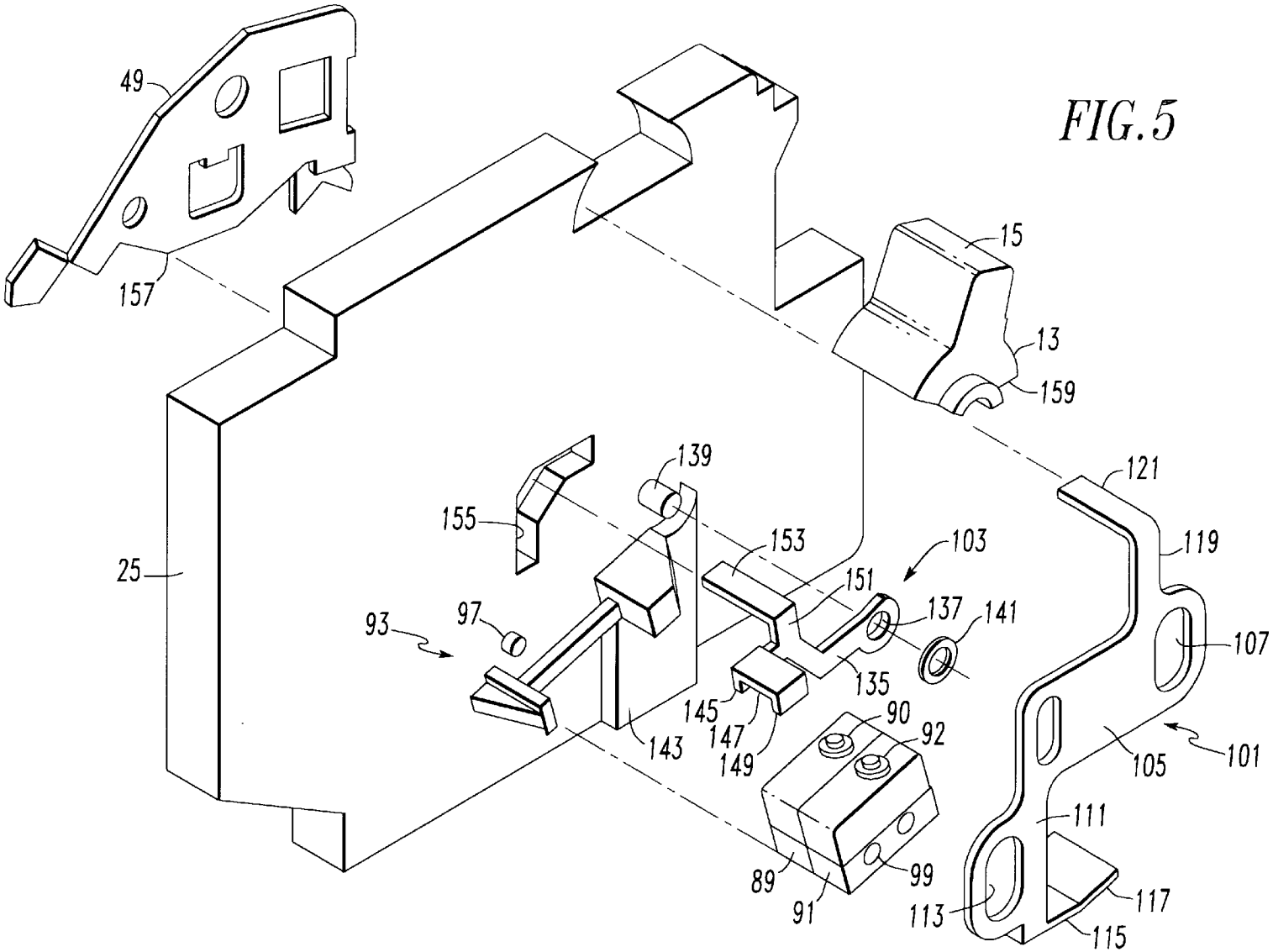
FIG. 5 is an exploded isometric view of selected parts of the circuit breaker shown in FIGS. 1 through 4.

The housing 3 defines a compartment 19 (see FIG. 2) in which a circuit breaker mechanism 21 is housed, and a second compartment 23 (see FIG. 3), separated from the compartment 19 by a center panel 25 (see FIG. 5).

The circuit breaker mechanism 21, as is generally known, includes a pair of separable contacts 29, including a fixed contact 31 and a movable contact 33, a supporting metal frame 35, an operating mechanism 37, and a trip device 39. The fixed contact 31 is connected by a conductor 41 to the line terminal 9.

The operating mechanism 37 includes a flat electrically conductive generally C-shaped contact arm 43 to which the movable contact 33 is secured at the lower end. The upper end of the contact arm has a notch 45 which is biased against a projection 47 on the operating member 13 in a manner to be discussed. The operating member 13 is mounted in the housing 3 for rotation about an axis perpendicular to the plane of FIG. 2. Motion is transmitted from the operating member 13 to the contact arm 43 when the circuit breaker 1 is manually operated, and from the contact arm 43 to the operating member 13 when the breaker is automatically tripped.

The operating mechanism 37 further includes a latchable cradle 49 which is pivotally supported at one end by a pivot 51 molded into the center panel 25. The other end 53 of the cradle 49 is latched by the trip device 39 in a manner to be discussed. The ends of the latchable cradle 49 are offset and disposed along a plane which is parallel to a plane in which the main body portion of the latchable cradle 49 is disposed. This places the ends of the cradle 49 in essentially the same plane as the C-shaped contact arm 43. A spring 55 is connected, under tension, at one end in slot 57 near the lower end of the C-shaped contact arm 43, and at the other end to a bent over tab 59 projecting outward from the main body of the latchable cradle 49.

The trip device 39 includes a bimetal 61 secured at an upper end to a bent over tab 63 on the frame 35. The contact arm 43 of the operating mechanism 37 is connected to the lower end of the bimetal 61 by a flexible conductor 65. The upper end of the bimetal 61 is connected by another flexible conductor 67 which in turn is connected to a tang 69 extending through an opening in the end wall of the housing 3. The load terminal 5 is connected to the external end of the tang 69 for connection of the circuit breaker to a load. The closed circuit through the circuit breaker 1 extends from the line terminal 9, conductor 41, fixed contact 31, movable contact 33, contact arm 43, flexible conductor 65, bimetal 61, flexible conductor 67, tang 69, and load terminal 5.

The trip device 39 further includes an elongated, rigid magnetic armature or latch member 71 mounted on a spring 73 which is welded to the free lower end of the bimetal 61. The magnetic armature 71 extends generally upward along side the bimetal 61, and has an opening 75 forming a latch surface 77 at the base of the opening. The latch end 53 of the cradle 49 is formed with a latch surface 77 and a stop surface or fulcrum part 81. The armature 71 serves as a stop to engage the fulcrum part 81 of the latchable cradle 49 in the latched position of the cradle. A U-shaped magnetic member 83 is secured to the bimetal 61 adjacent the magnetic armature 71 to concentrate the flux created by current flowing through the bimetal 61.

Figure 2:
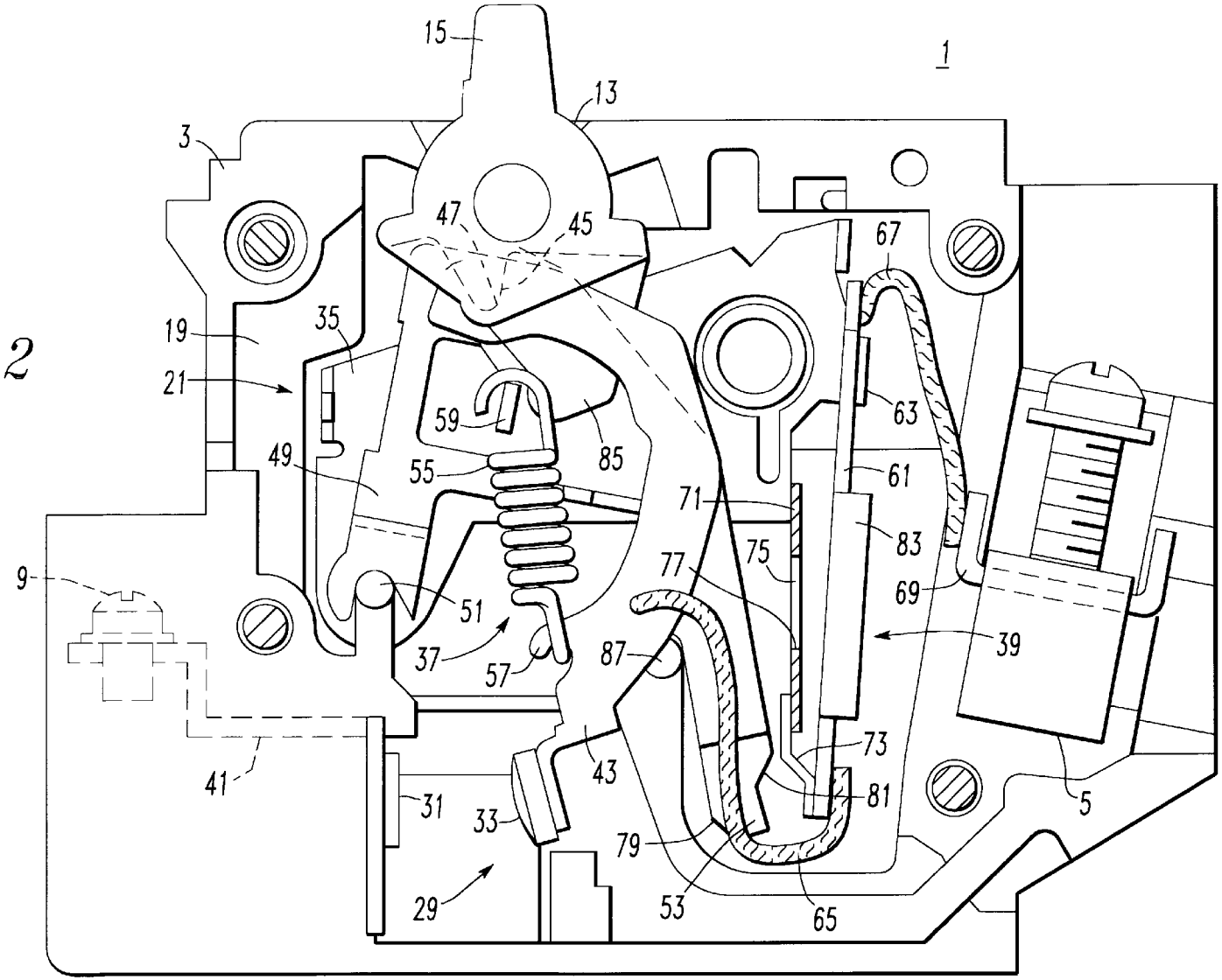
FIG. 2 is a vertical section taken along line 2—2 through the circuit breaker of FIG. 1.

The circuit breaker 1 is shown in FIG. 2 in the tripped position. The cradle 49 is latched for resetting the circuit breaker by rotating the handle 15 clockwise. This causes a projection 85 on the operating member 13 to engage the tab 59 and rotate the latchable cradle 49 in the counterclockwise direction until the latch end 53 is latched in the opening 75 in the magnetic armature 71.

The separable contacts 29 are closed by moving the handle 15, with the cradle 49 latched, in the counterclockwise direction as viewed in FIG. 2 to the on position. This causes the projection 47 on the operating member 13 which engages the notch 45 in the contact arm 43 to move the upper end of the contact arm to the right of the line of action of the spring 55 resulting in closure of the contacts 29. The contacts 29 could be manually opened from this closed position by rotating the handle 15 clockwise, as viewed in FIG. 2, to the off position.

The trip device 39 provides overcurrent protection through the bimetal 61. Prolonged currents above the rated current of the circuit breaker heats the bimetal 61 causing the lower end to deflect to the right, as shown in FIG. 2, thereby unlatching the cradle 49, as the armature 71 pivots about the fulcrum 81 until the latch surface 77 on the latch end 53 of the cradle slides off of the latch surface 77. When unlatched, the cradle 49 is rotated clockwise by the spring 55 until it engages a stop pin 87 molded in the center panel 25 of the circuit breaker housing. During this movement, the line of action of the spring 55 moves to the right of the pivot formed by the notch 45 in the contact arm 43 and the projection 47 on the operating member 13, whereupon the spring 55 biases the contact arm 43 in the opening direction to open the contacts 29 and moves the contact arm 43 so that the line of action of the force exerted by the spring on the operating member 13 shifts across the rotational axis of the operating member 13 and actuates the operating member to the tripped position shown in FIG. 2. The tripped position of the operating member 13 is intermediate the "on" and "off" positions. The operating member 13 is stopped in the intermediate or tripped position shown in FIG. 2 when the projection 85 engages the tab 59 on the cradle 49. The contact arm 43 is stopped in the open position shown in FIG. 2 when it engages the stop pin 87. The circuit breaker is reset following the trip in the manner discussed above.

The trip device 39 also provides short circuit protection. A very high current through the bimetal 61 produced by a short circuit induces a magnetic flux which is concentrated by the magnetic member 83 and of sufficient magnitude to attract the armature 71 to the magnetic member, thereby unlatching the cradle 49 to trip the circuit breaker.

Figure 4:
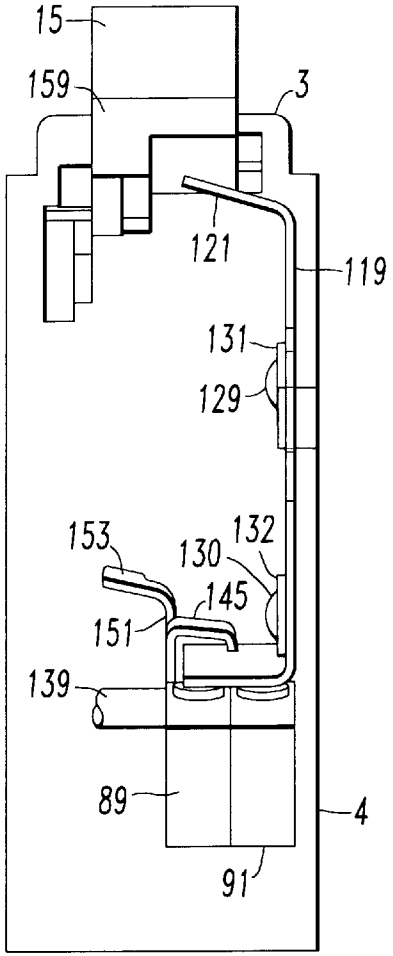
FIG. 4 is a vertical section taken along line 4—4 of the FIG. 3.
Figure 3:
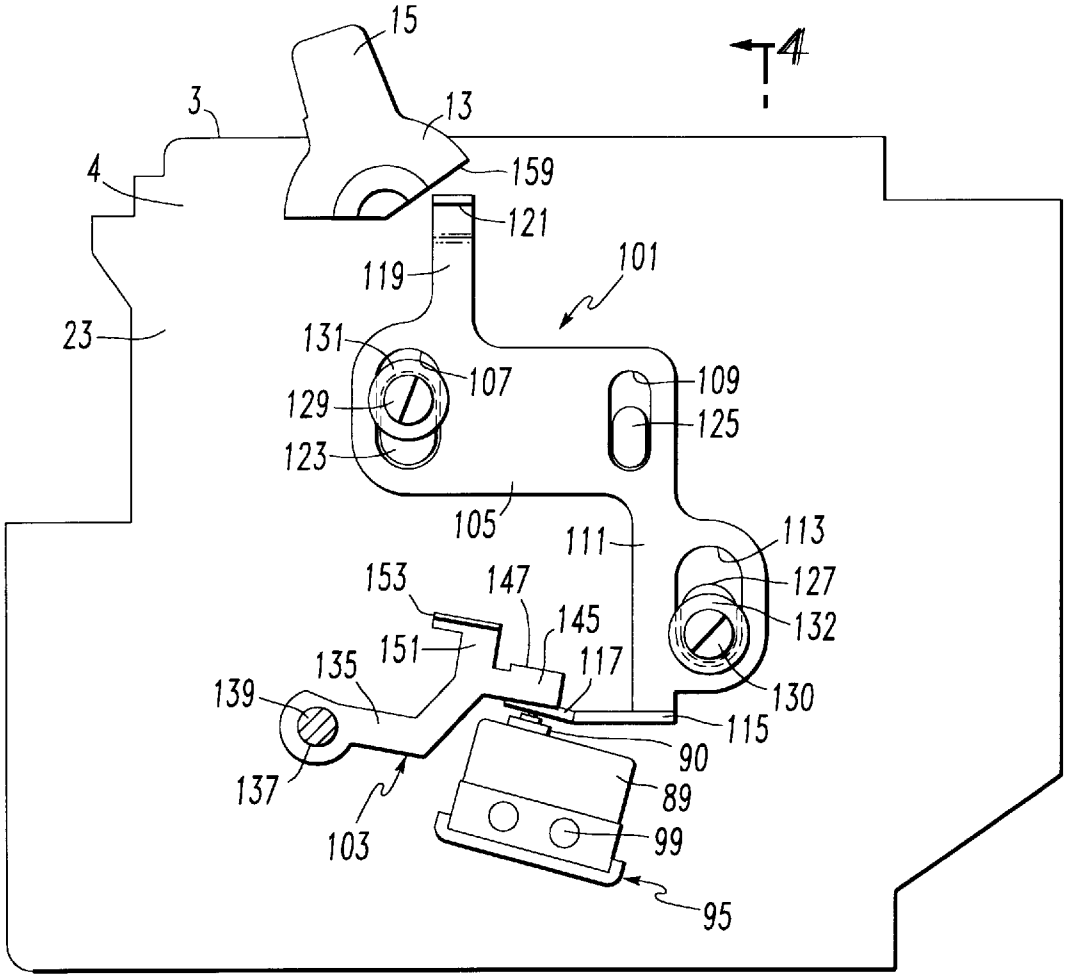
FIG. 3 is another vertical section to the circuit breaker of FIG. 1 taken along line 3—3.

Referring to FIGS. 3–5, the circuit breaker 1 incorporates a first microswitch 89 and a second microswitch 91, both of which are mounted in the compartment 23 of the housing 3. The first microswitch 89 includes a plunger 90 and the second microswitch 91 includes a plunger 92, as is generally known. Preferably, the first microswitch 89 and the second microswitch 91 are positioned adjacent one another and are maintained in place within the compartment 23 by a support member, generally designated by reference number 93, molded into the center panel 25 of the housing 3. A similar support member, generally designated by reference number 95, is molded into the housing 3 for supporting the first microswitch 89 and the second microswitch 91. A pin 97 may also be provided as a molded component of the center panel 25 for receipt in a bore 99 (see FIG. 3) of microswitch 89 to further support and maintain the microswitches in position. A similar pin arrangement (not shown) may be provided on the housing 3 for receipt in a bore 99 formed in the second microswitch 91. The microswitches 89 and 91 are conventional switches having both a normally open and a normally closed set of contacts actuated by the respective plungers 90 and 92. The microswitches 89 and 91 also include leads (not shown), as is generally known, that extend out of the housing 3 in order to provide remote signalling capabilities. The leads could also be utilized within the circuit breaker 1 such as, for example, being extended to a shunt trip coil to allow the microswitch 89 or microswitch 91 to act as a cutoff switch for the shunt trip coil. Other uses for the microswitches 89 and 91 that are generally known in the art for similar switches may also be employed with the invention.

The first microswitch 89 and the second microswitch 91 are actuated by actuating means including a first actuating member, generally designated by reference number 101, and a second actuating member, generally designated by reference number 103. The first actuating member 101 is preferably stamped from sheet metal material and has a wide center portion 105 with an elongated first opening 107 and an elongated second opening 109 formed therein. A first extension 111 extends downward from one side of the center portion 105 and includes an elongated third opening 113. The first extension 111 terminates in a first end 115 that is bent laterally inward therefrom and terminates in a tab 117 that is positioned at an angle with respect to the first end 115 such that the tab 117 is positioned for engagement with the plungers 90 and 92 of the first microswitch 89 and the second microswitch 91, respectively. The first actuating member 101 also includes a second extension 119 extending upwardly from the center portion 105. The second extension 119 terminates in a second end 121 that is bent laterally with respect to the second extension 119.

The first actuating member 101 is mounted for vertical, rectilinear movement within the housing 3 on the inside of rear cover 4. To guide the movement of the first actuating member 101, a first projection 123 is molded on the inside of rear cover 4 with the first projection 123 being received in the first opening 107 of the first actuating member 101. Similarly, a second projection 125 is received in the second opening 109 and a third projection 127 is received in the third opening 113. The first actuating member 101 may be retained in place by a first screw 129 and cooperating washer 131 where the screw 129 extends through the first opening 107 and into the housing 3 (see FIG. 4). The screw 129 is not completely tightened against the washer 131 and first actuating member 101. It will be appreciated that this arrangement retains the first actuating member 101 in place but does not prevent the described vertical, recitlinear movement of the first actuating member 101. Similarly, a second screw 130 extends through the third opening 113 and cooperates with a washer 132 for retaining the first actuating member 101 in place. Other means, such as for example a tinnerman grooveless washer, may be utilized to retain the first actuating member 101 in place.

The second actuating member 103 is also preferably stamped from sheet metal material and includes an enlarged central portion 135 with an aperture 137 formed on one end of the central portion 135. The second actuating member 103 is pivotally mounted on a molded pin 139 on the center panel 25 and is retained in place by a speed nut 141, or other means such as for example a tinnerman grooveless washer (not shown). The second actuating member 103 is positioned adjacent a molded projection 143 formed on the center panel 25 to both guide and limit movement of the second actuating member 103.

The central portion 135 of the second actuating member 103 includes a first end 145 extending therefrom opposite the aperture 137 formed on the other end of the central portion 135. The first end 145 includes a lateral extension 147 terminating in a bent tab 149 which extends generally perpendicularly downward from the lateral extension 147. The lateral extension 147 and the tab 149 are offset from the plane which contains the central portion 135 and first end 145. This allows for the lateral extension 147 and the tab 149 to extend over and engage the tab 117 of the first end 115 of the first actuating member 101. Advantageously, this allows the tab 149 to engage generally the center of the tab 117 between the two switches to distribute the actuating force and to simultaneously depress the plungers 90 and 92 through the tab 117 of the first actuating member 101.

The second actuating member 103 also includes an extension 151 extending generally upwardly from the central portion 135 terminating in a bent over tab 153 which forms a second end of the second actuating member 103. The tab 153 extends through an opening 155 in the center panel 25 of the housing 3 and projects below the lower edge 157 of the center portion of the cradle 49.

The tab 149 on the first end 145 of the second actuating member 103 bears against and operates the first microswitch 89 and the second microswitch 91 through the tab 117 on the first end 115 of the first actuating member 101, so that the first actuating member 101 and the second actuating member 103 are cascaded for operation of the first microswitch 89 and the second microswitch 91. The second end 121 of the first actuating member 101 bears against a cam surface 159 on the underside of the operating member 13. This cam surface 159 is contoured so that with the handle 15 in the off position, the first actuating member 101 is deflected downward to depress the plunger 90 of the first microswitch 89 and the plunger 92 of the second microswitch 91. Under the circumstances described, actuation of the microswitches 89 and 91 will then provide an indication that the handle 15 is in the off position or that the circuit breaker 1 is tripped.

In operation, when the circuit breaker 1 is turned on, the separable contacts 29 are closed, the cradle 49 is latched, and the handle 15 is in the on position. When the circuit breaker 1 is tripped, the cradle 49 is unlatched and is rotated clockwise as viewed in FIG. 2 so that the lower edge 157 of the cradle 49 bears against the tab 153 of the second actuating member 103 thereby rotating the second actuating member 103 counterclockwise as viewed in FIG. 5 so that the tab 149 engages generally the center of the tab 117 of the first actuating member 101 to achieve a simultaneous depression of the plungers 90 and 92 of the first microswitch 89 and the second microswitch 91. Actuation of the microswitches 89 and 91 provides an indication that the contacts 29 are open.

When the circuit breaker 1 is turned off, the handle 15 is rotated to the right of vertical as viewed in FIG. 3 so that the cam surface 159 wedges against the second end 121 of the first actuating member 101 to force the first actuating member 101 downward. This downward movement of the first actuating member 101 causes the tab 117 formed on the first end 115 of the first actuating member 101 to simultaneously depress the plungers 90 and 92 of the first microswitch 89 and the second microswitch 91, respectively. This also provides an indication that the contacts 29 are open.

Figure 6:
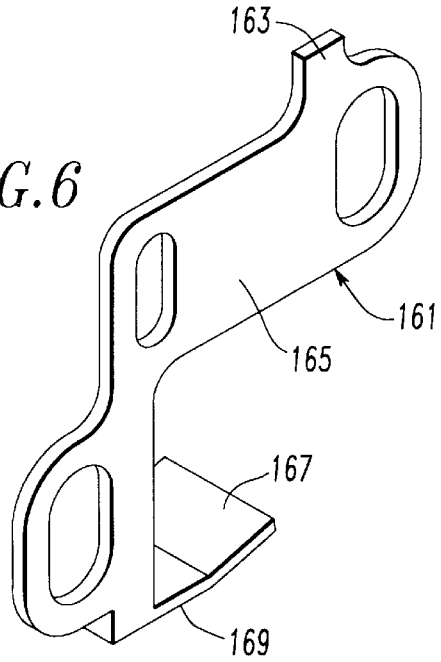
FIG. 6 is an isometric view of another embodiment of the first actuating member of the invention.

Referring to FIG. 6, another embodiment of the first actuating member is shown. Specifically, first actuating member 161 is similar to the previously described first actuating member 101 only the second extension 163, which extends upward from the central portion 165 does not include a second end or tab extending therefrom. This prevents the first actuating member 161 from being actuated by the cam surface 159 of the handle 15 as described in the previous embodiment. This arrangement results in the first microswitch 89 and the second microswitch 91 being actuated only as a result of rotation of the second actuating member 103 and the tab 149 thereof engaging generally the center of the tab 167 formed on the first end 169 of the first actuating member 161 to simultaneously depress the plungers 90 and 92. Actuation of the first microswitch 89 and the second microswitch 91 then provides an indication that a tripping operation has occurred.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

a circuit breaker mechanism including:

a fixed contact;

a contact arm;

a movable contact secured to one end of said contact arm and movable by said contact arm toward and way from said fixed contact to close and open said contacts:

a pivotally mounted operating member engaging another end of said contact arm for moving, and for movement by, said contact arm between off/open and on/closed positions of said operating member and said contacts respectively, said operating member having an integral handle and a cam surface;

a pivotally mounted latchable cradle;

a spring connecting said latchable cradle and said contact arm; and a trip device latching said cradle in a latched position and unlatching said cradle in response to preset current conditions, said cradle tripping said contact arm to open said contacts and move said operating member to a tripped position when unlatched;

a first microswitch having a plunger;

a second microswitch having a plunger;

said first and second microswitches positioned adjacent one another;

actuating means including a first actuating member and a second actuating member, said first actuating member bearing against said cam surface on said operating member, said cam surface actuating said first and second microswitches through said first actuating member when said operating member and said integral handle are in the off position;

said second actuating member engaging said cradle and actuating said first and second microswitches through said first actuating member when said cradle is unlatched, said first and second actuating members being cascaded to operate said plunger of said first microswitch and said plunger of said second microswitch; and a housing with first and second compartments separated by a partition, wherein said contacts, said contact arm, said spring, said cradle, and said trip device are mounted in said first compartment, and said first and second microswitches are mounted in said second compartment, wherein said operating member extends into both compartments with said cam surface located in said second compartment, said partition having an opening through which said second actuating member extends to engage said cradle and wherein said first actuating member is mounted in said second compartment to engage said camming surface and actuate said first and second microswitches.

2. The circuit breaker of claim 1 wherein:

said first actuating member has a first end engaging said plunger of said first microswitch and said plunger of said second microswitch for simultaneous depression thereof and a second end engaging said cam surface; and said second actuating member has a first end engaging said first end of said first actuating member to simultaneously depress said plunger of said first microswitch and said plunger of said second microswitch and a second end engaging said cradle.

3. The circuit breaker of claim 2 wherein:

said first end of said first actuating member includes a first tab, said first end of said second actuating member engaging generally the center of said first tab to achieve a simultaneous depression of said plunger of said first microswitch and said plunger of said second microswitch.

4. The circuit breaker of claim 3 including:

means for mounting said first actuating member for rectilinear motion; and means for mounting said second actuating member for pivotal motion.

5. The circuit breaker of claim 2 wherein:

said first end of said second actuating member includes a lateral extension having a second tab extending generally downward therefrom for engaging said first tab.

6. A circuit breaker comprising:

a circuit breaker mechanism including:

a fixed contact;

a contact arm;

a movable contact secured to one end of said contact arm and movable by said contact arm toward and way from said fixed contact to close and open said contacts:

a pivotally mounted operating member engaging another end of said contact arm for moving, and for movement by, said contact arm between off/open and on/closed positions of said operating member and said contacts respectively, said operating member having an integral handle;

a pivotally mounted latchable cradle;

a spring connecting said latchable cradle and said contact arm; and a trip device latching said cradle in a latched position and unlatching said cradle in response to preset current conditions, said cradle tripping said contact arm to open said contacts and move said operating member to a tripped position when unlatched;

a first microswitch having a plunger;

a second microswitch having a plunger;

said first and second microswitches positioned adjacent one another;

actuating means including a first actuating member and a second actuating member, said second actuating member engaging said cradle and actuating said first and second microswitches through said first actuating member when said cradle is unlatched, said first and second actuating members being cascaded to operate said plunger of said first microswitch and said plunger of said second microswitch; and a housing with first and second compartments separated by a partition, wherein said contacts, said contact arm, said spring, said cradle, and said trip device are mounted in said first compartment, and said first and second microswitches and said actuating means are mounted in said second compartment, wherein said operating member extends into both compartments, said partition having an opening through which said second actuating member extends to engage said cradle and wherein said first actuating member is mounted in said second compartment.

7. The circuit breaker of claim 6 wherein:

said first actuating member has an end for engaging said plunger of said first microswitch and said plunger of said second microswitch for simultaneous depression thereof; and said second actuating member has a first end engaging said end of said first actuating member to simultaneously depress said plunger of said first microswitch and said plunger of said second microswitch and a second end engaging said cradle.

8. The circuit breaker of claim 7 wherein:

said end of said first actuating member includes a tab, said first end of said second actuating member engaging generally the center of said tab to achieve a simultaneous depression of said plunger of said first microswitch and said plunger of said second microswitch.

9. The circuit breaker of claim 8 including:

means for mounting said first actuating member for rectilinear motion; and means for mounting said second actuating member for pivotal motion.

* * * * *